US006393848B2

(12) United States Patent
Roh et al.

(10) Patent No.: US 6,393,848 B2
(45) Date of Patent: May 28, 2002

(54) INTERNET REFRIGERATOR AND OPERATING METHOD THEREOF

(75) Inventors: Young Hoon Roh, Seoul; Kwang Choon Kim; Jin Cheol Cho, both of Kyonggi-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/759,522

(22) Filed: Jan. 16, 2001

(30) Foreign Application Priority Data

Feb. 1, 2000 (KR) ..... 2000-4990
Feb. 1, 2000 (KR) ..... 2000-4991
Feb. 1, 2000 (KR) ..... 2000-4992

(51) Int. Cl.[7] ..... F25B 49/02
(52) U.S. Cl. ..... 62/126; 236/51
(58) Field of Search ..... 62/125, 126, 127, 62/129, 130; 236/51, 94; 165/11.1

(56) References Cited

U.S. PATENT DOCUMENTS 5,279,458 A * 1/1994 DeWolf et al. ..... 236/51 X
5,682,329 A * 10/1997 Seem et al. ..... 62/126 X
5,682,949 A * 11/1997 Ratcliffe et al. ..... 236/51 X

* cited by examiner

*Primary Examiner*—Harry B. Tanner
(74) *Attorney, Agent, or Firm*—Birch, Stewart, Kolasch & Birch, LLP

(57) ABSTRACT

An Internet refrigerator and a method of operating the Internet refrigerator are disclosed. The Internet refrigerator includes a modem for performing a data communication with remote communication devices through the Internet, a first control section for controlling constituent elements of the refrigerator, a touch panel for producing key signals in accordance with a user's touch, a second control section for controlling other constituent elements of the refrigerator including the first control section in response to the key signals provided from the touch panel and key signals from the remote communication devices, a display section for displaying necessary information under the control of the second control section, and an Internet connection device for connecting the refrigerator to the Internet. The Internet refrigerator operating method uses internal information of the Internet refrigerator and information from the external communication devices. According to the Internet refrigerator and the operating method thereof, home automation centering around a kitchen can be implemented.

30 Claims, 15 Drawing Sheets

INTERNET REFRIGERATOR AND OPERATING METHOD THEREOF

BACKGROUND OF THE INVENTION

1. Field of the Invention

The present invention relates an Internet refrigerator and a method of operating the Internet refrigerator, and more particularly to an Internet refrigerator that can perform data communications with external communication devices and an operating method thereof.

2. Background of the Related Art

Generally, a refrigerator comprises a main body, a freezing room for storing therein frozen foodstuffs, a refrigerating room for cold-storing therein foodstuffs, a compressor for cooling the freezing room and the refrigerating room, and a control circuit including a microcomputer. The refrigerator is a home appliance basically used in a kitchen, and its size gradually becomes larger.

The kitchen space where the refrigerator is installed is not only the simple space for a dietary life in accordance with the change of the living habit of the moderns. In the kitchen, members of a family not only take a meal but also have a talk together. That is, the kitchen is changing to a main living space in the home. Accordingly, the refrigerator, which is a core element in the kitchen space, and becomes large-sized, is required to provide diverse entertainments, a remote control function, and other service functions.

Most conventional refrigerators only have their own refrigeration functions, but do not provide the entertainments, remote control function, and other service functions. For instance, in order to effectively use the refrigerator, the user should refer to a manual, but it is difficult for a general user to accurately understand the contents of the manual. As a result, the conventional refrigerator has the drawbacks in that the user should individually make inquiries at a service center in order to accurately user his/her refrigerator.

SUMMARY OF THE INVENTION

Accordingly, the present invention is directed to an Internet refrigerator and a method of operating the Internet refrigerator that substantially obviate one or more of the problems due to limitations and disadvantages of the related art.

An object of the present invention is to provide an Internet refrigerator which enables a remote control of the refrigerator and an operating method thereof.

It is another object of the present invention to provide an Internet refrigerator having an entertainment function and an operating method thereof.

It is still another object of the present invention to provide an Internet refrigerator which can provide additional other services to a user in addition to its own refrigeration function and an operating method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the Internet refrigerator comprises a refrigerator control section for controlling whole constituent elements of the refrigerator, a touch panel for providing key signals related to an operation of the refrigerator itself and key signals for effecting communications with the Internet according to a user's selection, a remote controller for remotely providing the key signals related to the operation of the refrigerator itself and the key signals for effecting communications with the Internet according to the user's selection, a display section, provided on an outer wall of the refrigerator, for displaying information related to the operation of the refrigerator itself and information obtained from the Internet in response to the key signals from the touch panel and the key signals from external devices through the Internet, a main control section for performing a bidirectional communication with the refrigerator control section and the Internet and controlling the display section in response to the key signals from the touch panel, the key signals from the Internet, and the key signals from the remote controller, a dedicated communication control section for managing the bidirectional communication between the refrigerator control section and the main control section, and an Internet connection device connected between the Internet and the main control section by a dedicated communication line for the bidirectional communication between the Internet and the main control section.

In another aspect of the present invention, there is provided a method of operating an Internet refrigerator comprising the steps of detecting a key signal inputted from a key input device and inputted from external devices through an Internet connection device by a user, controlling constituent elements of the refrigerator in response to the key signal if it is detected that the key signal is related to an operation of the refrigerator itself, displaying through a display device first information from the refrigerator itself and from the external devices in response to the key signal if it is detected that the key signal is a signal for displaying the first information, transmitting second information of the refrigerator to the external devices in response to the key signal if it is detected that the key signal is a signal for transmitting the second information to the external devices through the Internet connection device, and storing third information from the refrigerator itself and from the external devices through the Internet connection device in a memory of the refrigerator in response to the key signal if it is detected that the key signal is a signal for storing the third information in the memory.

As described above, since the refrigerator according to the present invention has the Internet function, the user can confirm information on the operation state of the refrigerator itself and foodstuffs stored in the refrigerator only by the simple input of the key signal from a remote place using the external communication devices. Also, the user can view images from an external database through the display device provided on the Internet refrigerator.

According to the Internet refrigerator according to the present invention, the user can also control the operation of the refrigerator using the external communication device. Also, the user can perform the schedule management, and can be provided with various kinds of services.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, the embodiments of the present invention will be explained with reference to the accompanying drawings.

Figure 1:
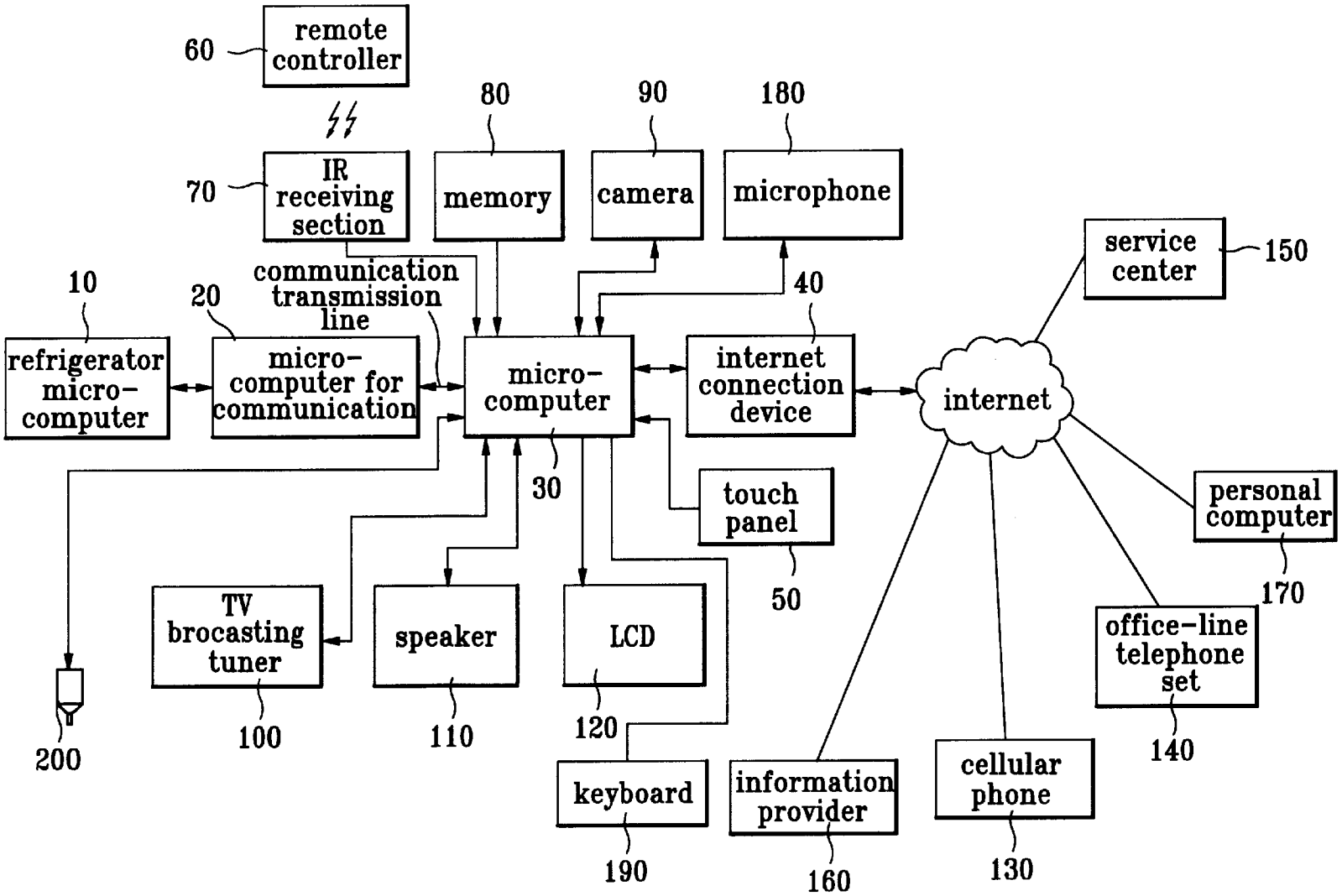
FIG. 1 is a block diagram illustrating the Internet refrigerator and external communication devices connected to the Internet refrigerator according to the present invention.

FIG. 1 is a block diagram illustrating the Internet refrigerator and external communication devices connected to the Internet refrigerator according to the present invention.

Referring to FIG. 1, the Internet refrigerator includes a refrigerator microcomputer 10, a dedicated communication microcomputer 20, a main microcomputer 30, an Internet connection device 40, a touchpanel 50, a remote controller 60, an infrared ray (IR) receiving section 70, a memory 80, a camera 90, a tuner 100, a speaker 110, and a liquid crystal display (LCD) 120. In FIG. 1, external communication devices are a cellular phone 130, an office-line telephone set 140, a service center 150, an information provider 160, a personal computer 170, a microphone 180, and a keyboard 190.

The refrigerator microcomputer 10 functions to control the essential constituent elements of the Internet refrigerator, and the dedicated communication microcomputer 20 functions to control communications between the main microcomputer 30 and the refrigerator microcomputer 10. At this time, a dedicated communication line such as an RS232 is used for connecting the main microcomputer 30 to the dedicated communication microcomputer 20, and for connecting the refrigerator microcomputer 10 to the dedicated communication microcomputer 20. The touch panel 50 is installed on the screen of the LCD 120, and provides the key signals related to the operation of the refrigerator itself and the key signals for effecting communications with the Internet according to the user's selection. The remote controller 60 remotely provides the key signals related to the operation of the refrigerator itself and the key signals for effecting communications with the Internet according to the user's selection. The LCD 120 is installed on an outer wall of the refrigerator, and displays the information related to the operation of the refrigerator itself and the information received from the external communication devices 130 to 170 through the Internet in response to the key signals from the touch panel 50 and the key signals from the external communication devices through the Internet. The main microcomputer 30 performs a bidirectional communication with the refrigerator microcomputer 10 and the external communication devices 130 to 170 through the Internet. The main microcomputer 30 also controls the LCD 120 in response to the key signals. The Internet connection device 40 functions to connect the main microcomputer 30 to the external communication devices 130 to 170 through the Internet. The Internet connection device 40 includes a modem and a local area network (LAN) connection device.

Meanwhile, the microphone 180 is connected to the main microcomputer for a voice communication with the Internet. The speaker 110 outputs voice information according to the operation of the refrigerator itself and the use of the Internet through the refrigerator under the control of the main microcomputer 30. The memory 80 stores therein necessary text, voice, and image information and outputs the stored information under the control of the main microcomputer 30. The keyboard 190 is connected by wire to the main microcomputer 30, and provides the key signals to the microcomputer 30 according to the user's selection.

Meanwhile, the text, voice, and image information stored in the memory 80 may be information made by the user, or a music file or a moving image provided from the external communication devices 130 to 170 including the information provider 160 through the Internet. The keyboard 190 is connected by wire to the main microcomputer 30, and provides to the main microcomputer 30 the key signals for operating the refrigerator itself, and the key signals for effecting communications with the external communication devices 130 to 170 through the Internet as well.

Here, the information sent/received between the main microcomputer 30 and the external communication devices 130 to 170 through the Internet includes information for informing the operation state of the refrigerator, information corresponding to a user manual of the refrigerator, information on details of foodstuffs stored in the refrigerator, cooking information from the information provider 160, information on a menu for health from the information provider 160, message information, memo information, information on schedule management, voice and image information from the external communication devices 130 to 170, information on a television broadcasting signal, information on an MPEC signal, information related to an after-sale service of the refrigerator, information for externally controlling the operation of the refrigerator, living information from the information provider 160, stock information from the information provider 160, and Internet operation information from the information provider 160.

As described above, the external communication devices may be a personal computer, cellular phone, wire telephone set, PCS, service center, and information provider such as a portal service provider. Meanwhile, the LCD panel 120 is used as a display device of the Internet refrigerator. The touch panel 50 is unitedly mounted on a screen of the LCD panel 120, and composed of a number of coordinate values. If the user touches one coordinate of the touch panel 50, a voltage value of the corresponding coordinate is transferred to the main microcomputer 30. The main microcomputer 30 recognizes the key signal corresponding to the coordinate, and performs the corresponding function.

Figure 2:
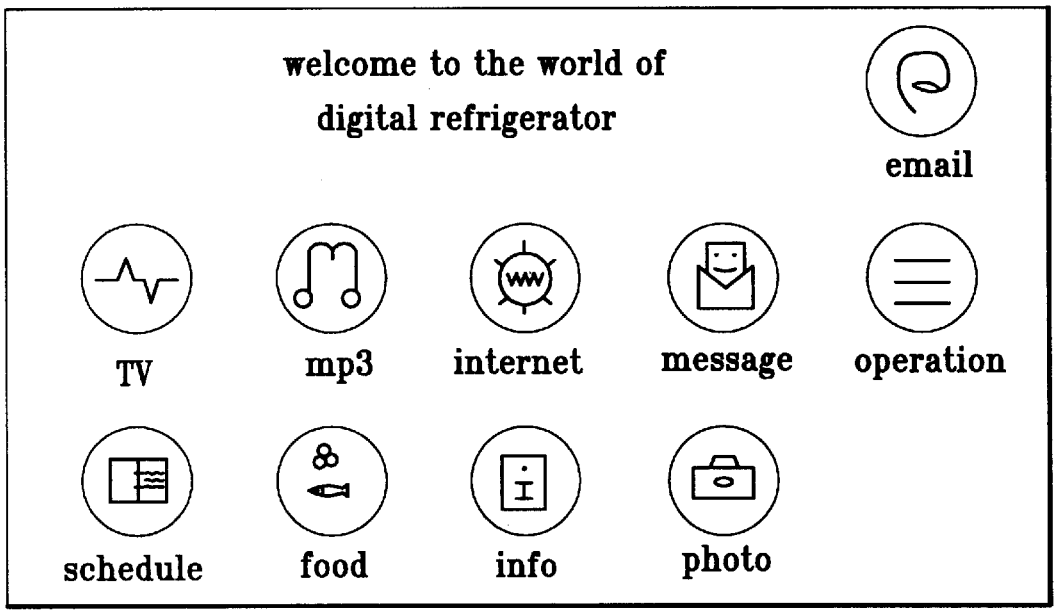
FIG. 2 is a diagram illustrating keys of a touch panel 50 in a window environment.

FIG. 2 is a diagram illustrating keys of the touch panel 50 in the window environment. As shown in FIG. 2, in the window environment of the LCD, the touch panel includes a message key used for a memo transferring function among members of a family, an MPEC3 key for listening to a music file and accessing a moving image, an Internet key for accessing the Internet, a food key for grasping information on the foodstuffs in the refrigerator, an information key for accessing general information including living information, a photo key for accessing image and photograph information, a schedule key for scheduling information such as a special anniversary, important appointment day, phone number list, etc., key for accessing an e-mail, key for receiving a television broadcasting signal, and operation key for operating the refrigerator.

Figure 3:
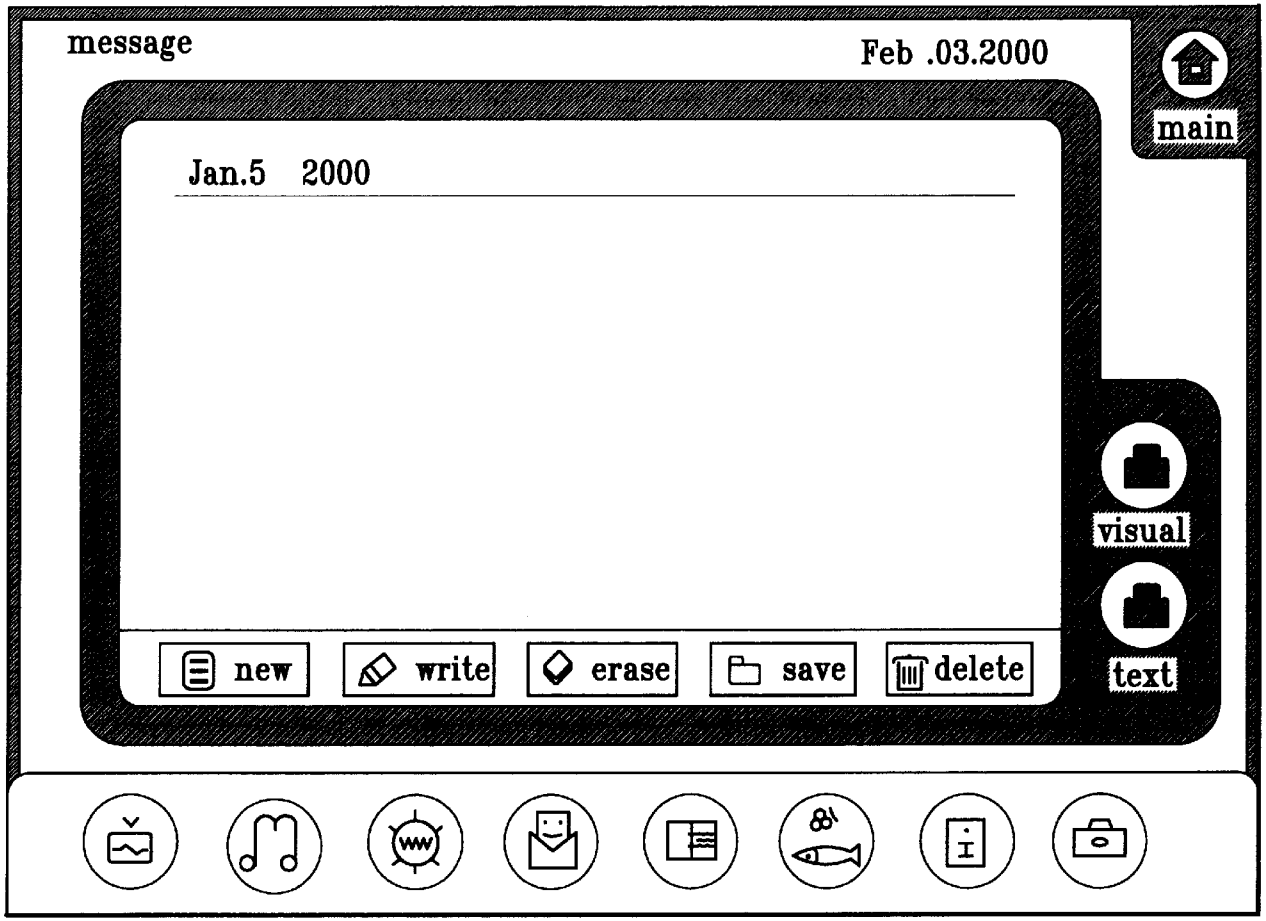
FIG. 3 is a diagram illustrating keys in a sub-window according to a message key.

FIG. 3 is a diagram illustrating keys in a sub-window according to a message key. In FIG. 3, the message key has one sub-window environment on the screen of the touch panel, and includes a visual message key, text message key, new message key, writing key, erase key, save key, and delete key. In FIG. 3, a main key is for converting the sub-window into a main window.

Figure 4:
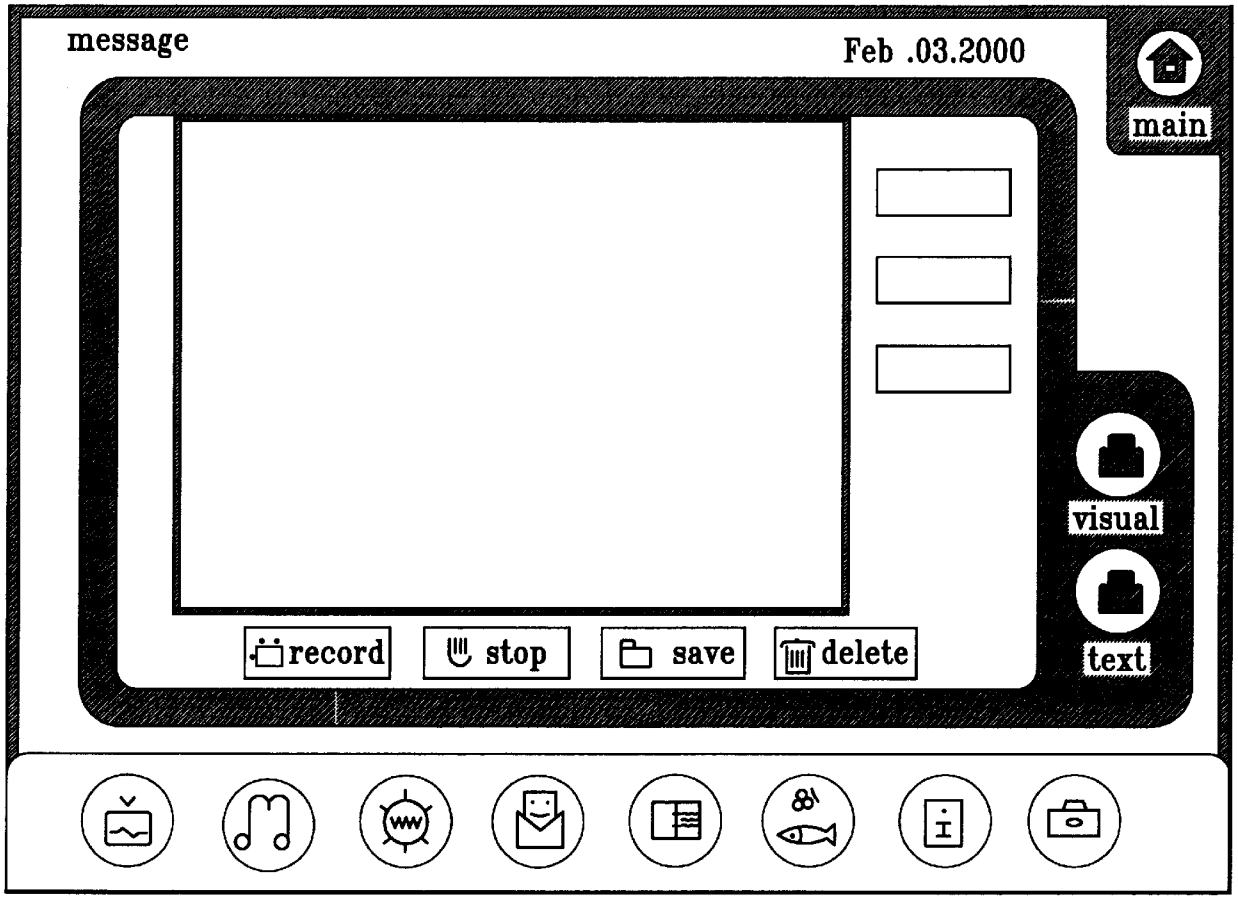
FIG. 4 is a diagram illustrating keys in another sub-window according to a message key.

FIG. 4 is a diagram illustrating keys in another sub-window according to a message key. In FIG. 4, the message key includes a write key, stop key, save key, and delete key. FIG. 4 shows the sub-window according to the touch of the message key in case that the camera 90 is installed in the Internet refrigerator.

The visual message key is a key for inputting an image message accompanying an voice, and the text message key is a key for using only a text message.

Figure 5:
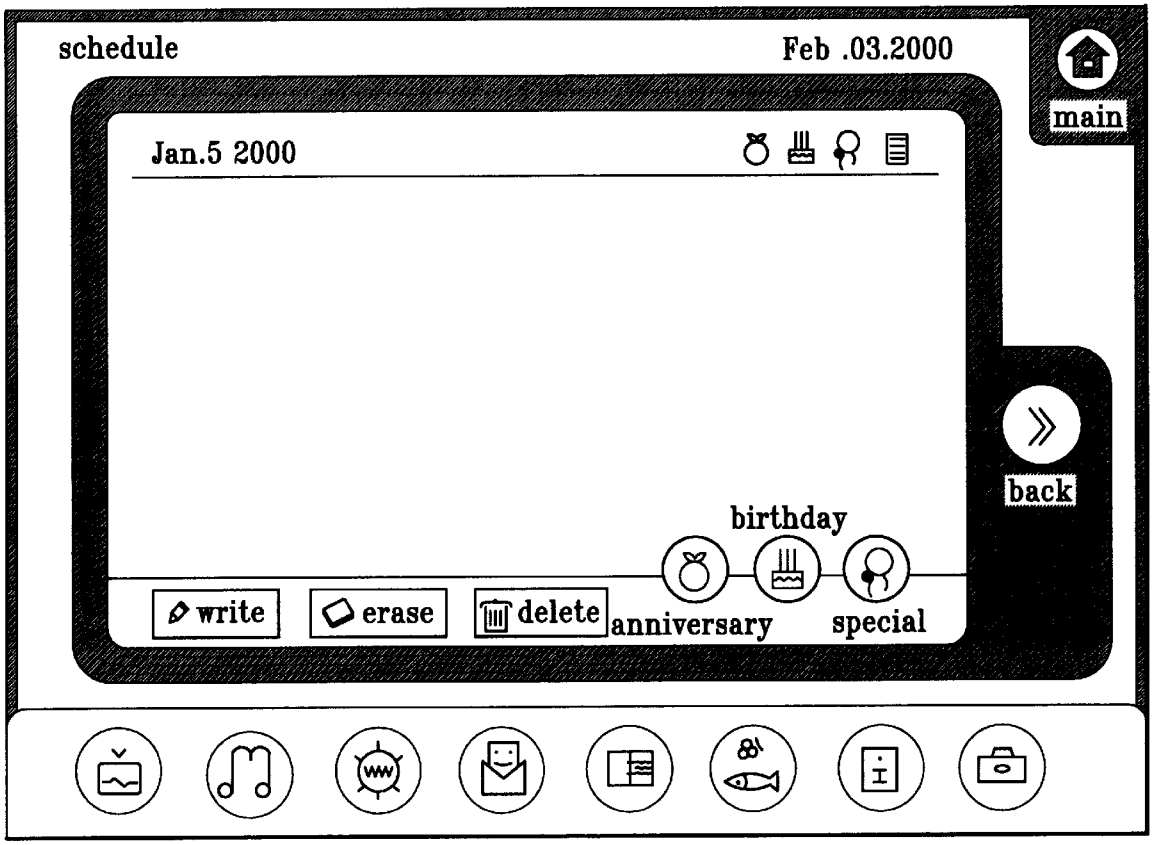
FIG. 5 is a diagram illustrating a sub-window in the unit of a day according to the touch of a schedule key.
Figure 6:
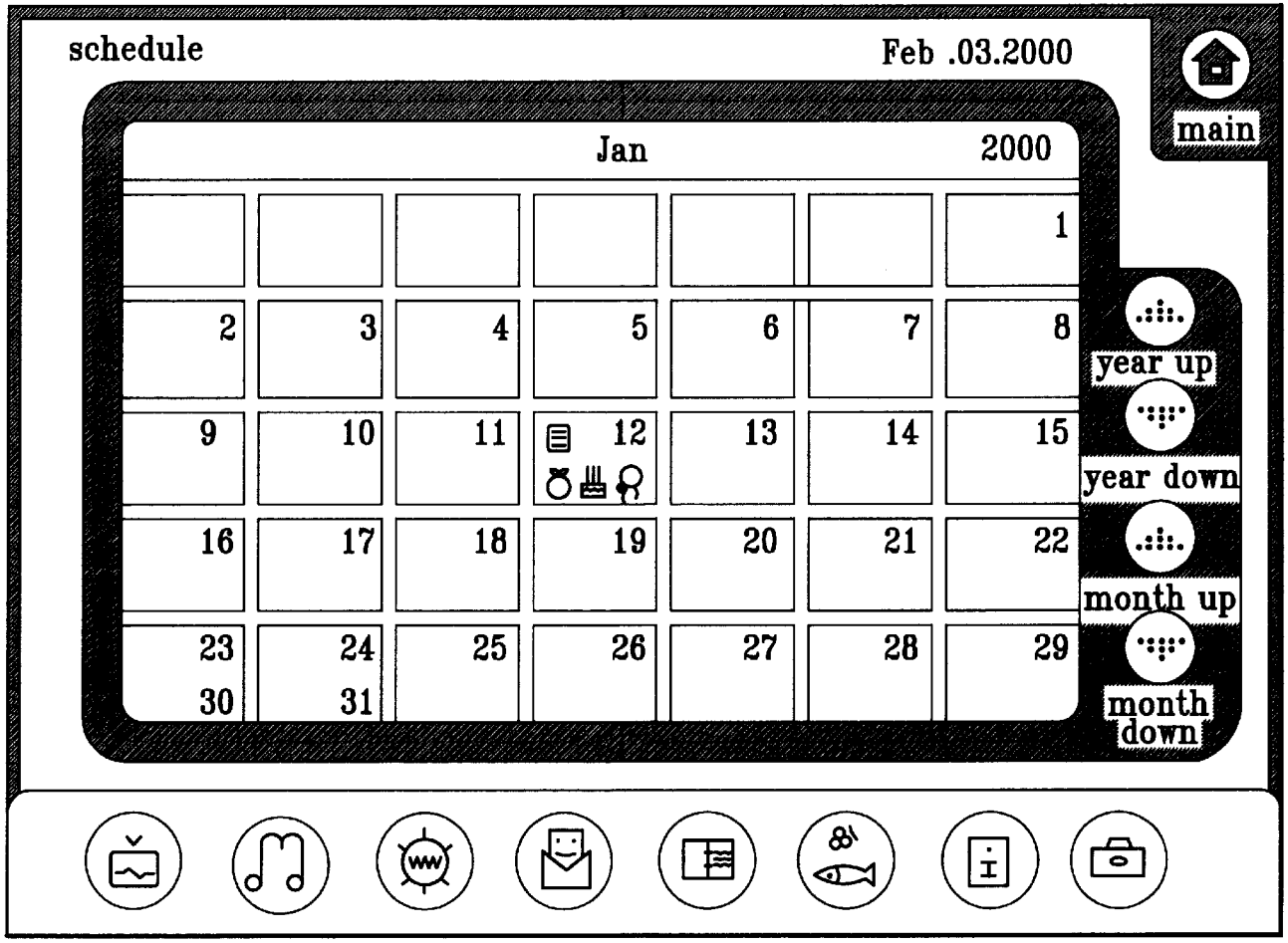
FIG. 6 is a diagram illustrating a sub-window in the unit of a month according to the touch of a schedule key.

FIG. 5 is a diagram illustrating a sub-window in the unit of a day according to the touch of a schedule key, and FIG. 6 is a diagram illustrating a sub-window in the unit of a month according to the touch of a schedule key.

Referring to FIG. 5, in a sub-window on the screen of the LCD panel 50, the schedule key includes a write key, erase key, delete key, anniversary key, birthday key, and special day key. In FIG. 5, a back key is a key for returning the sub-window to the previous window. By the symbols appearing on the right upper portion of FIG. 5, the user can recognize that Jan. 5, 2000 is marked for a birthday, anniversary, special day, and memo recorded. In FIG. 6, the schedule key includes a year up key, year down key, month up key, and month down key. In FIG. 6, Jan. 12, 2000 is marked for an anniversary, birthday, and event. Accordingly, the user can recognize that such an event is planned.

In FIG. 5, in the sub-window corresponding to the schedule key, the anniversary key, birthday key, and special key are for marking that the corresponding day is the anniversary, birthday, and special day, respectively. As described above, the information displayed on the LCD panel 120 under the control of the main microcomputer includes the text information and image information, and the voice information is also outputted through the speaker 110 along with the text and image information displayed.

Figure 7:
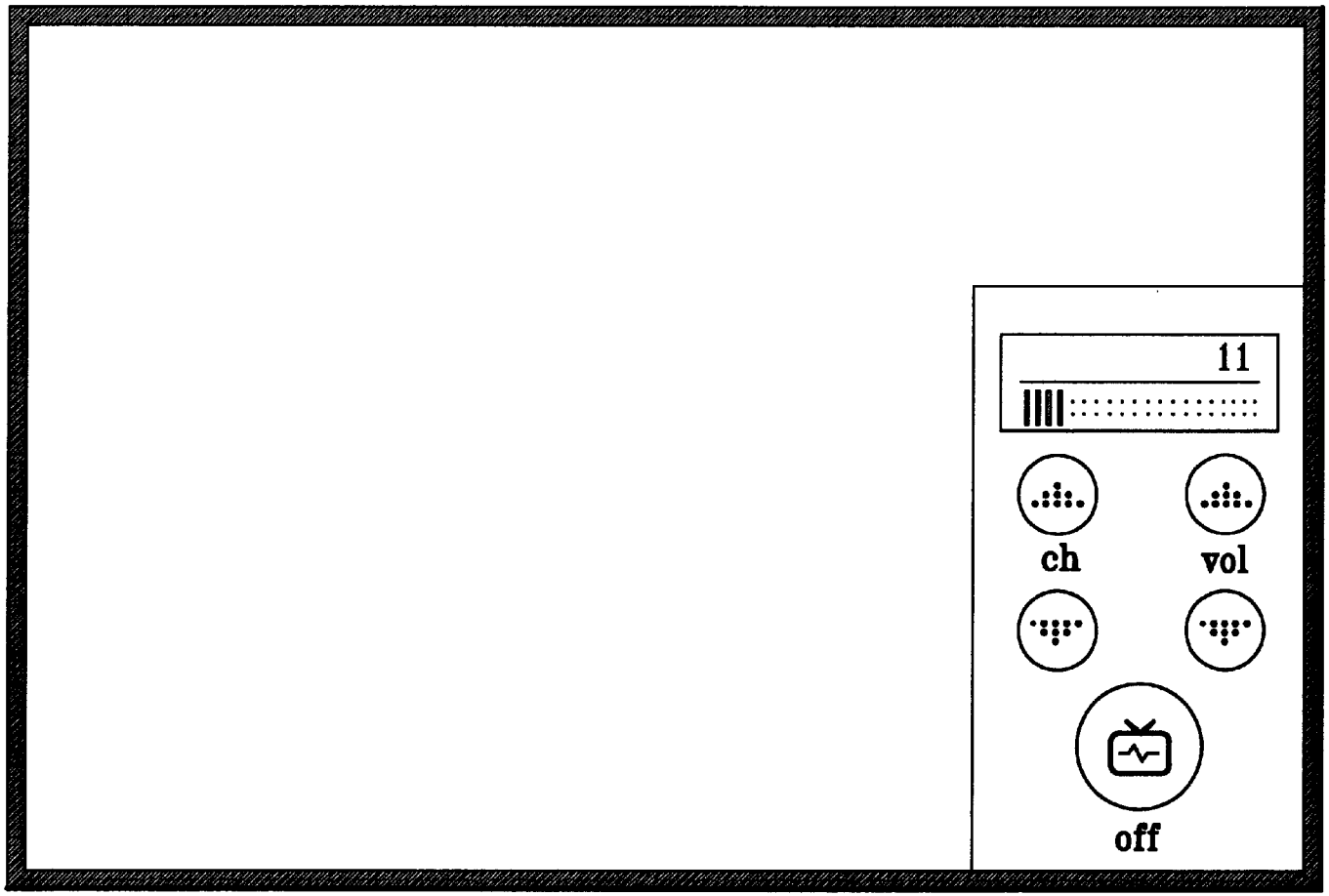
FIG. 7 is a diagram illustrating a sub-window screen according to a television broadcasting key.

FIG. 7 is a diagram illustrating the sub-window screen according to the television broadcasting key. In FIG. 7, the television broadcasting key includes a channel up key, channel down key, volume up key, volume down key, and television broadcasting off key.

Figure 8:
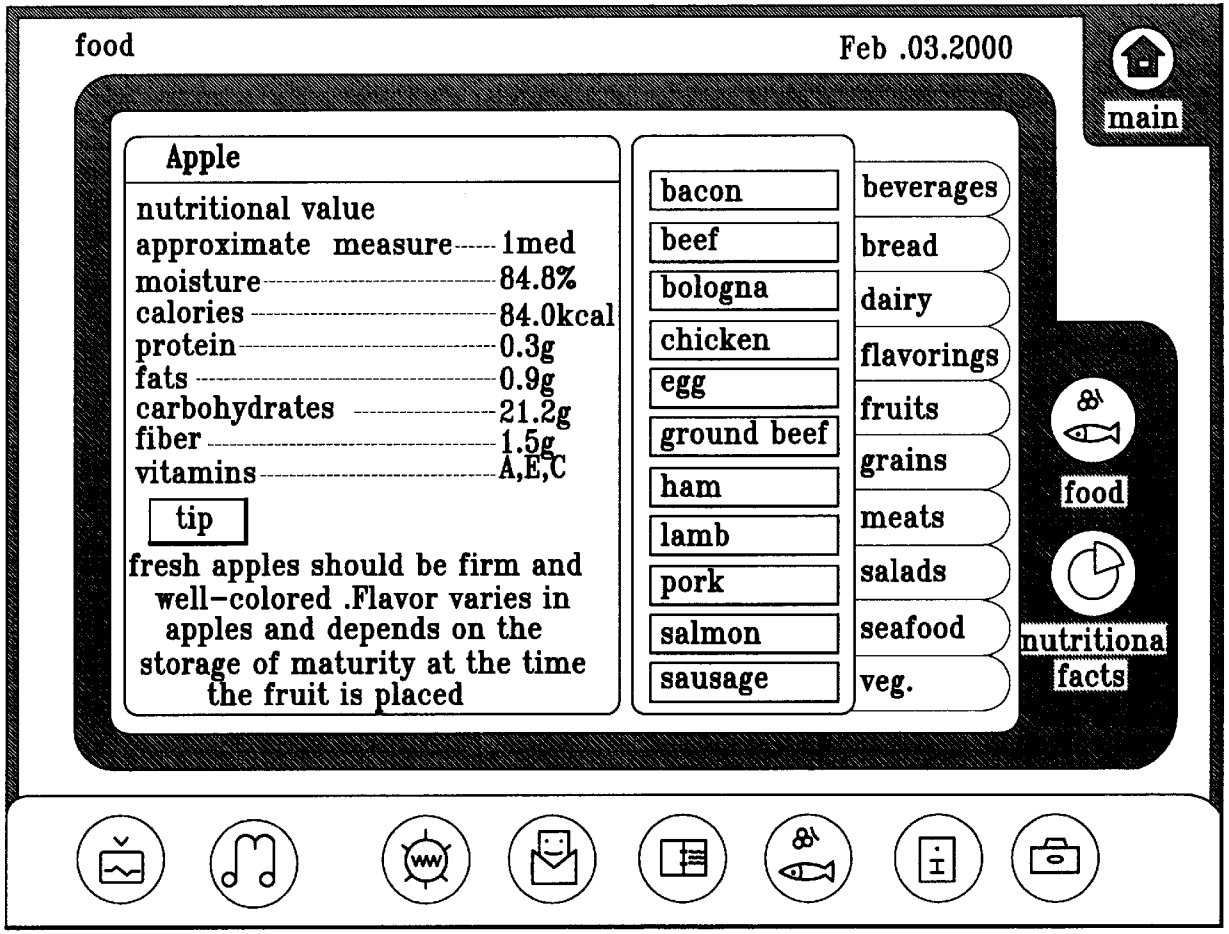
FIG. 8 is a diagram illustrating a sub-window screen according to the touch of a food key of FIG. 2.

FIG. 8 is a diagram illustrating a sub-window screen according to the touch of a food key of FIG. 2. In FIG. 8, the food key includes a key for selecting a desired food, and a key for displaying nutritive elements of the selected food.

Figure 9:
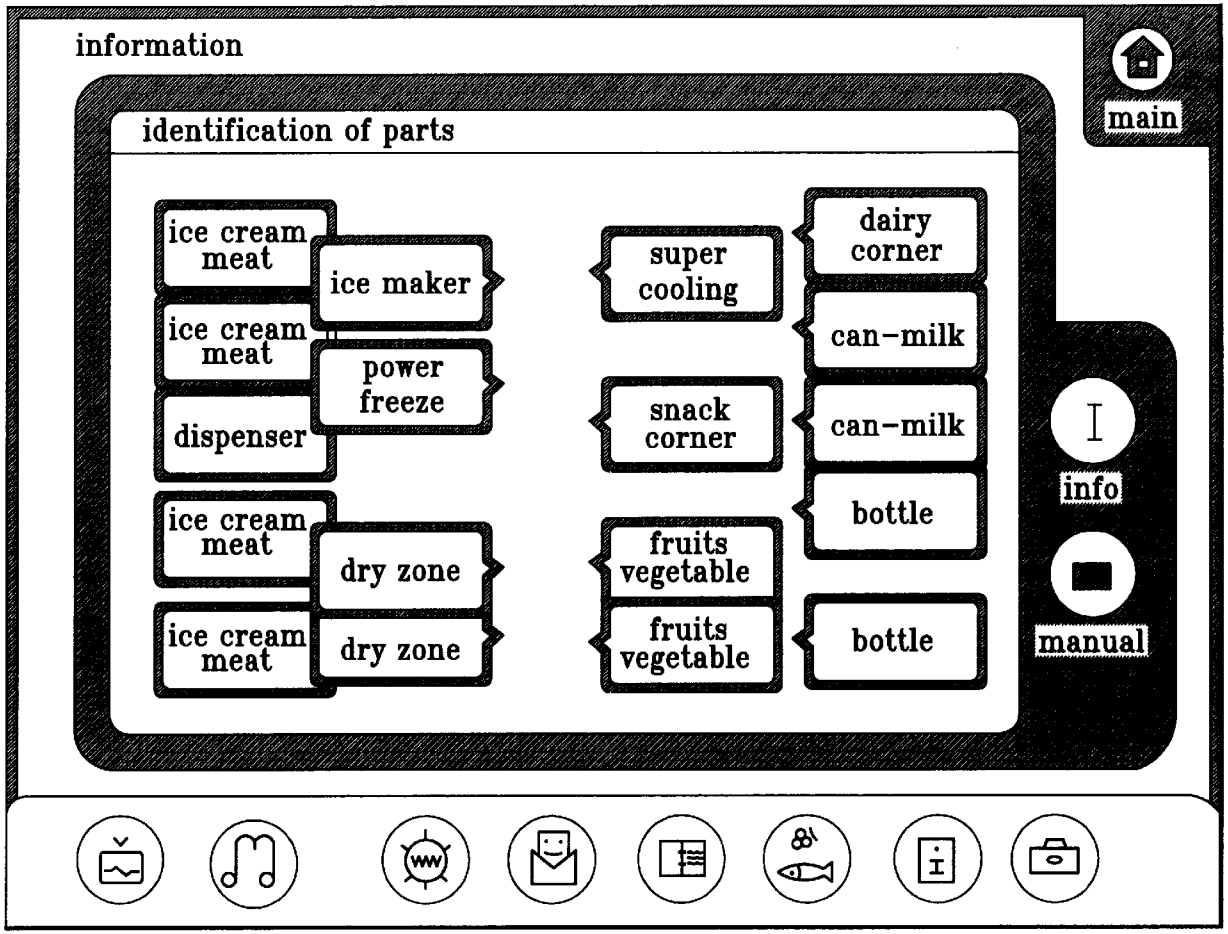
FIG. 9 is a diagram illustrating a sub-window screen displayed according to the touch of an information key of FIG. 2.

FIG. 9 is a diagram illustrating a sub-window screen displayed according to the touch of an information key of FIG. 2. In FIG. 9, the contents of foods placed on respective parts in the refrigerator are displayed on the LCD panel 120 in accordance with the touch of the information key. The information key includes a sub information key for selecting desired information in the sub-window environment, and a key for referring to a user s manual of the refrigerator.

Figure 10:
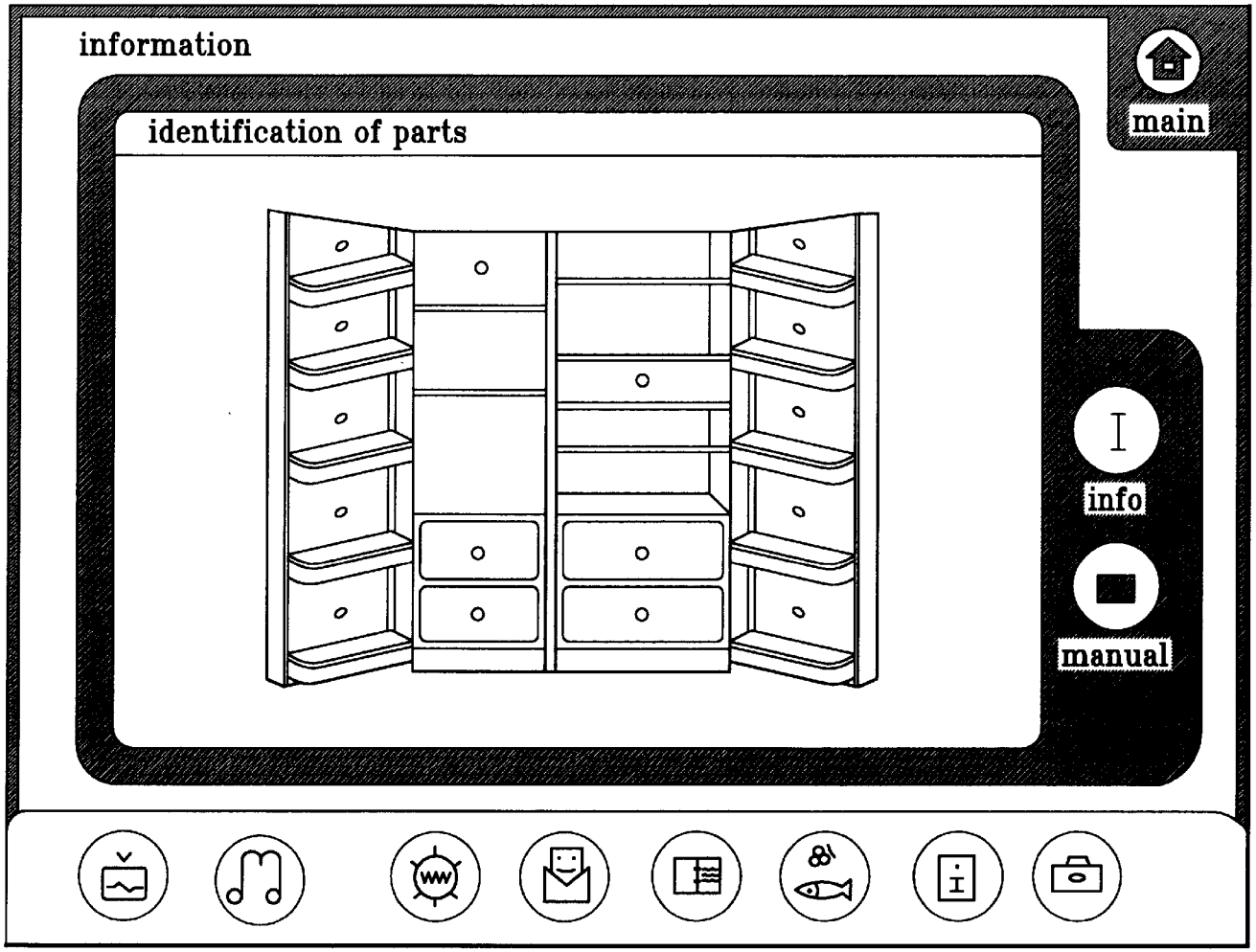
FIG. 10 is a diagram illustrating another sub-window displayed according to the touch of a manual key on the sub-window screen of FIG. 9.

FIG. 10 is a diagram illustrating another sub-window displayed according to the touch of a manual key on the sub-window screen of FIG. 9, and shows the internal structure of the refrigerator displayed on the LCD 120. As shown in FIG. 10, if the manual key on the sub-window screen is touched, not only the internal constituent elements of the refrigerator but also methods of using the constituent elements can be recognized.

Figure 11:
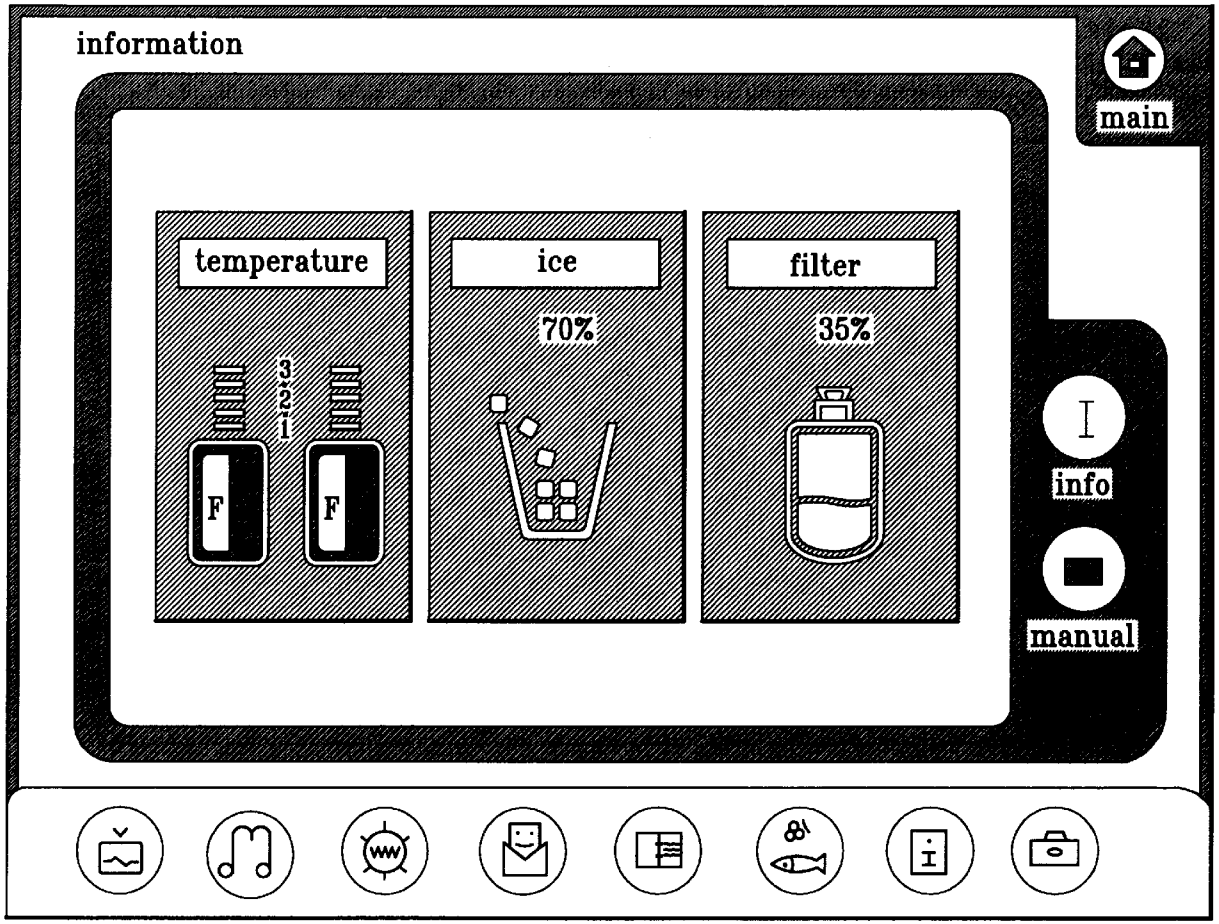
FIG. 11 is a diagram illustrating another sub-window selected by the touch of a sub information key on the sub-window screen of FIG. 9.

FIG. 11 is a diagram illustrating another sub-window selected by the touch of a sub information key on the sub-window screen of FIG. 9. According to the screen of FIG. 11, the user can identify the current temperature of the refrigerating room and the freezing room, and how much ice is filled in an ice container. Also, the user can identify the time for exchange of a water purifying filter. As described above, the main microcomputer 30 performs the bidirectional data communication with the refrigerator microcomputer 10 to identify the state of the constituent elements of the refrigerator itself.

Figure 12:
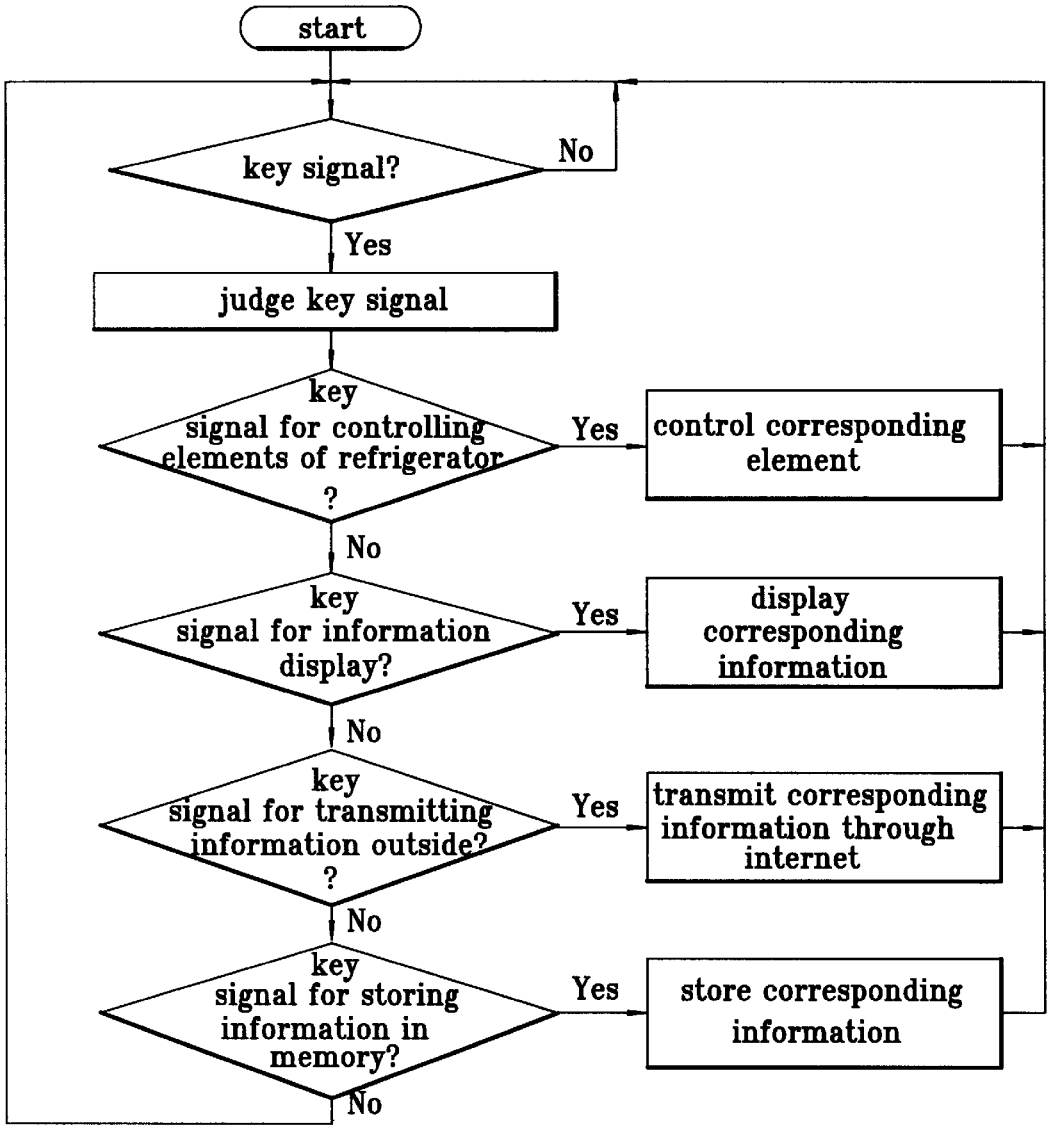
FIG. 12 is a flowchart illustrating a method of operating the Internet refrigerator according to the present invention.

Hereinafter, the method of operating the Internet refrigerator according to the present invention will be explained in detail based on the above-described construction of the refrigerator. FIG. 12 is a flowchart incorporating the operating method according to the present invention, which is divided into five steps.

Specifically, the operating method according to the present invention includes the steps of detecting a key signal inputted from the touch panel 50 and inputted from the external communication devices 130 to 190 through the Internet connection device 40 by a user, controlling constituent elements of the refrigerator in response to the key signal if it is detected that the key signal is related to the operation of the refrigerator itself, displaying through the display device 120 first information from the refrigerator itself and from the external communication devices 130 to 190 in response to the key signal if it is detected that the key signal is a signal for displaying the first information, transmitting second information corresponding to a state of the refrigerator itself to the external communication devices 130 to 190 in response to the key signal if it is detected that the key signal is a signal for transmitting the second information to the external communication devices 130 to 190 through the Internet connection device 40, and storing third information from the refrigerator itself and from the external communication devices 130 to 190 through the Internet connection device 40 in a memory 80 of the refrigerator in response to the key signal if it is detected that the key signal is a signal for storing the third information in the memory 80.

As shown in FIG. 1, the devices for inputting the key signals are a keyboard that is connected by wire to the main microcomputer 30 and is detachable from the refrigerator, a touch panel unitedly formed on the LCD 120, and a remote controller for providing remote key signals to the main microcomputer 30.

In the flowchart of FIG. 12, the key signals for controlling the constituent elements of the refrigerator are a signal for turning on/off the power supply of the refrigerator, a signal for adjusting the temperature in the refrigerator, and a signal for determining or converting the state of the refrigerator into a refrigerating state or a freezing state.

Meanwhile, in case that the key signal for displaying the corresponding information on the LCD 120 is the key signal related to the manual, the system program of the main microcomputer 30 may perform the following operation. First, it displays the structure of the refrigerator on the screen of the LCD 120, and then enlarges and displays the constituent element selected from the structure of the refrigerator by the user. Thereafter, it displays the information on the operation, function, and parts of the constituent element of the refrigerator selected and enlarged by the user.

Meanwhile, according to the system program, if the key signal is the key signal related to the input/output of the message and memo, it verifies the qualification of the person who requested the input/output before it inputs/outputs the second information and the third information corresponding to the message and the memo, respectively. If the qualification of the user is approved, it inputs the second information and the third information corresponding to the message and the memo from the external communication devices 130 to 190 through the Internet, or outputs them from the refrigerator to the external communication devices 130 to 190 through the Internet connection device. As described above, the second information and the third information corresponding to the message and the memo may be the text information, voice information, and image information. Also, the third information to be stored in the memory 80 may be the voice of the user, moving image personally prepared by the user, or voice, music file, and moving image provided from the external communication devices 130 to 190 through the Internet.

Meanwhile, the third information may be displayed on the LCD 120 in real time, and may be simultaneously stored in the memory 80.

The third information to be stored in the memory 80 may be the information of the refrigerator itself, or the information from the external communication devices 130 to 190. For example, the third information may be information on foodstuffs stored in the refrigerator written in the memory by the user, cooking information and menu information personally prepared by the user in consideration of dieting and health, and cooking information and menu information in consideration of dieting and health provided from the external communication devices 130 to 190 through the Internet. Also, the first to third information may be information on a personal and family schedules corresponding to an appointment day and event day. Also, the third information may be provided by the provider of the refrigerator, and may be an updated version of the user manual of the refrigerator previously stored in the memory 80. Also, the first to third information may be information on an Internet after-sale service between the refrigerator and the service center 150. That is, the user can make inquiries at the service center 150, and the service center 150 can give corresponding answers to the user. At this time, the first information is the information for diagnosing trouble of sensors installed in the refrigerator, trouble of a compressor, and trouble of other components of the refrigerator. The second information is the information on the present state of the sensors, compressor, and other components to be sent to the service center 150. The third information is the information on the diagnosis result from the service center 150 in accordance with the present state of the components. Also, the displayed first information may be the information on the present temperature of the freezing room of the refrigerator, present temperature of the refrigerating room, door open/close state of the refrigerator, compressor on/off state pf the refrigerator, and filter exchange time of the refrigerator.

Figure 13:
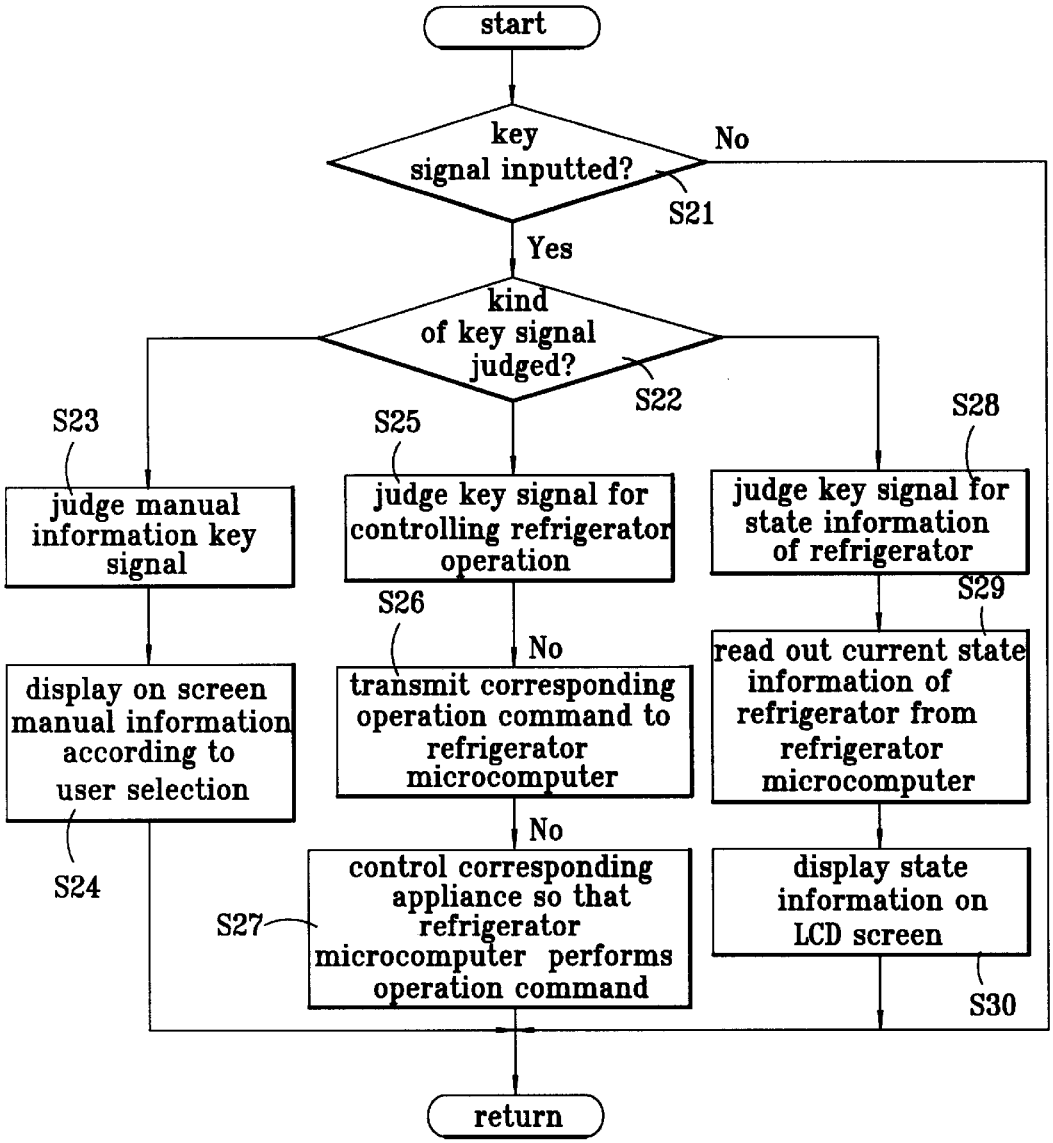
FIG. 13 is a flowchart illustrating a method of operating the Internet refrigerator according to a first embodiment of the present invention.

Hereinafter, the control method of the Internet refrigerator according to the present invention will be explained with reference to FIG. 13.

First, the main microcomputer 30 judges whether or not any key signal is inputted (step S21). At this time, the user inputs a desired key signal through the touch panel 50 as he/she views the screen of the LCD panel 120 installed on the outer surface of the refrigerator. Meanwhile, the user at a remote place connects to the main microcomputer 30 of the refrigerator through the Internet using the external communication devices 130 to 190 such as a portable terminal, notebook, desktop, etc., and inputs the desired key signal through the devices 130 to 190. Then, the main microcomputer 30 judges whether or not the key signal is inputted (step S21), and the kind of the input key signal is judged by the main microcomputer 30 (step S22). Then, if it is judged that the input key signal is a manual information key signal (step S23), the main microcomputer 30 reads out the corresponding image information for displaying the respective parts of the refrigerator from the memory 80, and displays them on the LCD panel 120. The additional information of the constituent elements selected by the user among the constituent elements of the refrigerator may be also read out from the memory 80, and displayed on the LCD panel 120 (step S24).

For example, if the user designates a specified constituent element on the screen where the constituent elements of the refrigerator are displayed, and presses a search key, the selected constituent element is enlarged and displayed along with the function of the constituent element. Meanwhile, if a component key is pressed, the information on the components of the selected constituent element is displayed on the screen, and if a help key is pressed, helping word information for the selected constituent element is displayed (step S24). Accordingly, the user can view the desired manual information of the refrigerator displayed through the LCD panel 120 or through the screen of the remote external communication devices 130 to 190.

Meanwhile, if it is judged that the key signal is the key signal for controlling the operation of the refrigerator (step S25), i.e., if the key signal is the operation control key signal such as power on/off, temperature adjustment, setting of refrigerating/freezing, etc., the main microcomputer 30 commands the refrigerator microcomputer 10 to perform the corresponding operation through the dedicated communication microcomputer 20 (step S26). Here, the operation control key signal includes the power on/off signal, temperature adjustment signal, and refrigerating/freezing setting signal.

The refrigerator microcomputer 10 controls the corresponding constituent element in response to the command transmitted from the main microcomputer 30 (step S27).

Meanwhile, if the key signal is the key signal for state information of the refrigerator (step S28) as a result of key signal judgement (S22), the main microcomputer 30 reads out from the refrigerator microcomputer 10 the information related to the current operating state of the refrigerator, i.e., the temperature of the refrigerating room and the freezing room, and the setting state of the refrigerating room and the freezing room (step S29). Then, the readout information is displayed on the screen of the LCD panel 120.

The user refers to the current operating state of the refrigerator through the screen of the LCD panel 120 and the remote external terminal, and gives a desired command to the refrigerator.

Also, since the refrigerator can be connected to the Internet, it can obtain the updated manual information or operating program downloaded from the Internet by the user or through a periodic Internet connection by a predetermined program. Accordingly, the software of the refrigerator can be upgraded.

Hereinafter, referring to FIG. 14, the operating method of the Internet refrigerator according to the second embodiment of the present invention will be explained in detail.

As described above, the touch panel 50 includes a message key connected to the system program used for transferring memos among the members of the family, a schedule key connected to the system program used for a specified anniversary of the family, important appointment, and telephone directory, and an Internet key connected to the system program used for the stock information and living information through the Internet.

The message key may comprise an input key and an output key for selecting an input and an output. The input key includes a visual key for inputting image and voice information through the camera 90 and the microphone 180, a text key for inputting a text message through the keyboard 190 and so on, and a text board key for inputting a desired message directly on the touch panel 50 using a specified pen. The output key enables the desired message to be searched through a one-touch operation on the touch panel 50 when the input message list is sequentially arranged and displayed on the LCD panel 120. The schedule key may comprise a day key for scheduling in the unit of a day, a month key in the unit of a month, and a year key in the unit of a year.

Figure 14:
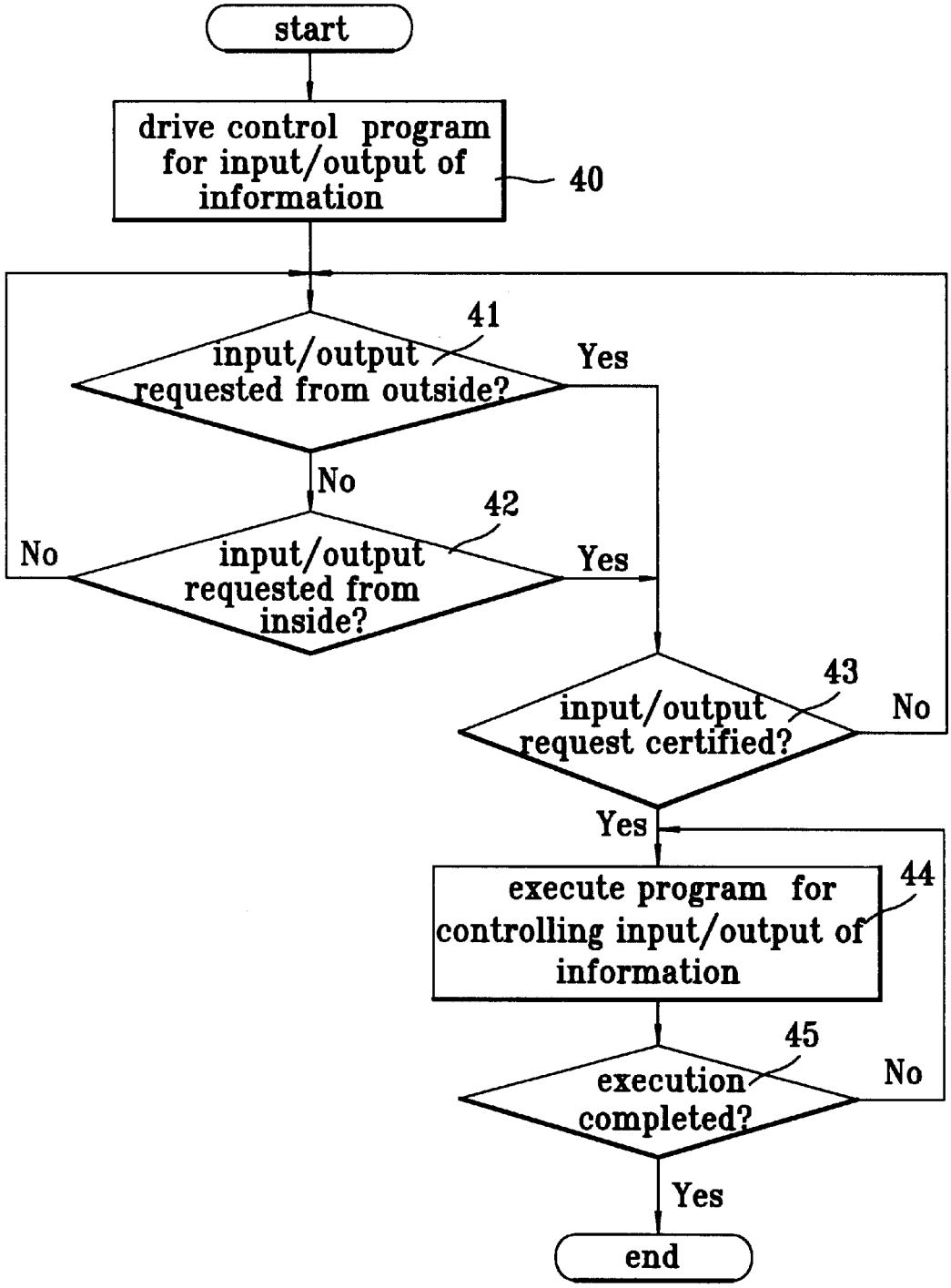
FIG. 14 is a flowchart illustrating a method of operating the Internet refrigerator according to a second embodiment of the present invention.

FIG. 14 is a flowchart illustrating a method of operating the Internet refrigerator according to the second embodiment of the present invention. In detail, FIG. 14 shows an example of the system program corresponding to the input and output of the information in the refrigerator.

First, if the power is supplied to the refrigerator, the system control program in the main microcomputer 30 is driven (step S40).

Then, the microcomputer 30 searches whether or not the input/output of information is requested from the external communication devices 130 to 190 through the Internet (step S41).

If such information is not requested from the external communication devices 130 to 190 as a result of search, the main microcomputer 30 then searches whether or not the input/output of the information is requested through the keyboard 190 of the refrigerator, the touch panel 50, ro the remote controller 60 (step S42). Here, the information means all the information including messages, schedules, living information, etc., stored in the memory 80.

If the input/output of the information is requested in the refrigerator itself or from the external communication devices 130 to 190, the main microcomputer 30 certifies the qualification of the requester (step S43).

If the qualification of the requester is approved as a result of certification, an approval signal is sent to the main microcomputer 30, and in response to the approval signal, the main microcomputer 30 executes the system program for controlling the input/output of the information stored in the memory 80 (step S44). Then, the main microcomputer 30 checks whether or not the execution of the system program is completed (step S45).

The main microcomputer 30 stores in the memory 80 or displays on the LCD panel 120 the corresponding information in accordance with the command of the requester. Also, the main microcomputer 30 inputs to the memory 80 or displays on the LCD panel 50 the information inputted from the external communication devices 130 to 190 through the Internet.

Hereinafter, storing of a name, address, and phone number in the memory 80 will be explained. In order to input a name, the user presses the schedule key or message key among the message key, schedule key, and Internet key displayed on the touch panel 50. Then, the user presses the input key between the input key and the output key displayed on the touch panel 50.

Thereafter, the user inputs desired information to the main microcomputer 30 using the keyboard 190, remote controller 60, keyboard displayed on the touch panel 50, and specified electronic pen 200.

For example, if the user inputs the name, work place, and phone number using the keyboard appearing on the touch panel 50, the main microcomputer 30 recognizes information on the inputted text and figures.

Then, the main microcomputer 30 stores the information on the inputted text and figures in the memory 80. That is, the user inputs information on the text and figures that the user desires to store through the keyboard appearing on the touch panel 50.

Meanwhile, the user can directly store the information on the text and figures in the memory 80 through the touch panel 50 using the electronic pen 200.

As described above, the user can store in the memory 80 the user s absence and memo through the touch panel 50 using the message key, and other members of the family can identify the user s absence and memo through the LCD panel 120 by outputting the message.

Meanwhile, in case that the user intends to store image and voice memo, the user first presses the visual key in the sub-window according to the touch of the message key. Then, the user stores the message of image and voice using the camera 90 and the microphone 180.

Also, the user can take part in a specified event day without fail by storing in the memory 80 the specified event day with a phone number or address of his/her relative or friend using the schedule key. The user can also calculate various public imposts in the kitchen using a downloaded calculation program, and store payment days of the various public imposts.

Meanwhile, the user can update and automatically store in the memory 80 the living information and stock information continuously changed using the Internet key. Accordingly, the user can be provided with the information with image and voice without searching the information one by one through the keyboard 190. That is, if the user pre-defines the information to be provided from an Internet information provider, the corresponding information is automatically stored in the memory 80.

Meanwhile, the user can be provided with the information stored in the memory 80 from the outside using the cellular phone 130 or personal computer 170.

Also, the Internet refrigerator according to the present invention can transmit voice and image information including a moving image to the external devices 130 to 190 through the Internet, and receive and output the voice and image information from the external devices 130 to 190 through the speaker 110 and the LCD panel 120.

The operating method of the Internet refrigerator as shown in FIG. 14 has the following working effect.

Since the refrigerator is connected to the Internet, a housewife spending much time in the kitchen can obtain the useful living information more conveniently.

Also, the user can search all the messages and schedules received from the outside and stored in the memory during his/her absence from home without brining a separate electronic pocket book.

Hereinafter, the operating method for a multimedia function of the Internet refrigerator will be explained with reference to FIGS. 1 to 15.

Referring to FIG. 1, the main microcomputer 30 controls storage or reproduction of the voice, music file, and moving image, and controls the whole Internet function of the refrigerator. The refrigerator microcomputer 10 performs the bidirectional communication with the main microcomputer 30, anc controls the constituent elements of the refrigerator itself. The Internet connection device 40 performs the Internet connection under the control of the main microcomputer 30. The memory 80 stores the voice of the user or the music file and the moving image downloaded from the information provider 160 through the Internet under the control of the main microcomputer 30. The LCD 120 displays the image signals stored in the memory 80 under the control of the main microcomputer 30. Meanwhile, the microphone 180 converts the voice of the user into an electric signal and stores converted signal in the memory 80 under the control of the main microcomputer 30. The speaker 110 functions to output the voice of the user to the outside while the user s voice through the microphone 180 is stored in the memory 80. The camera 90 photographs the moving image of the user and his/her surroundings under the control of the main microcomputer 30.

Figure 15:
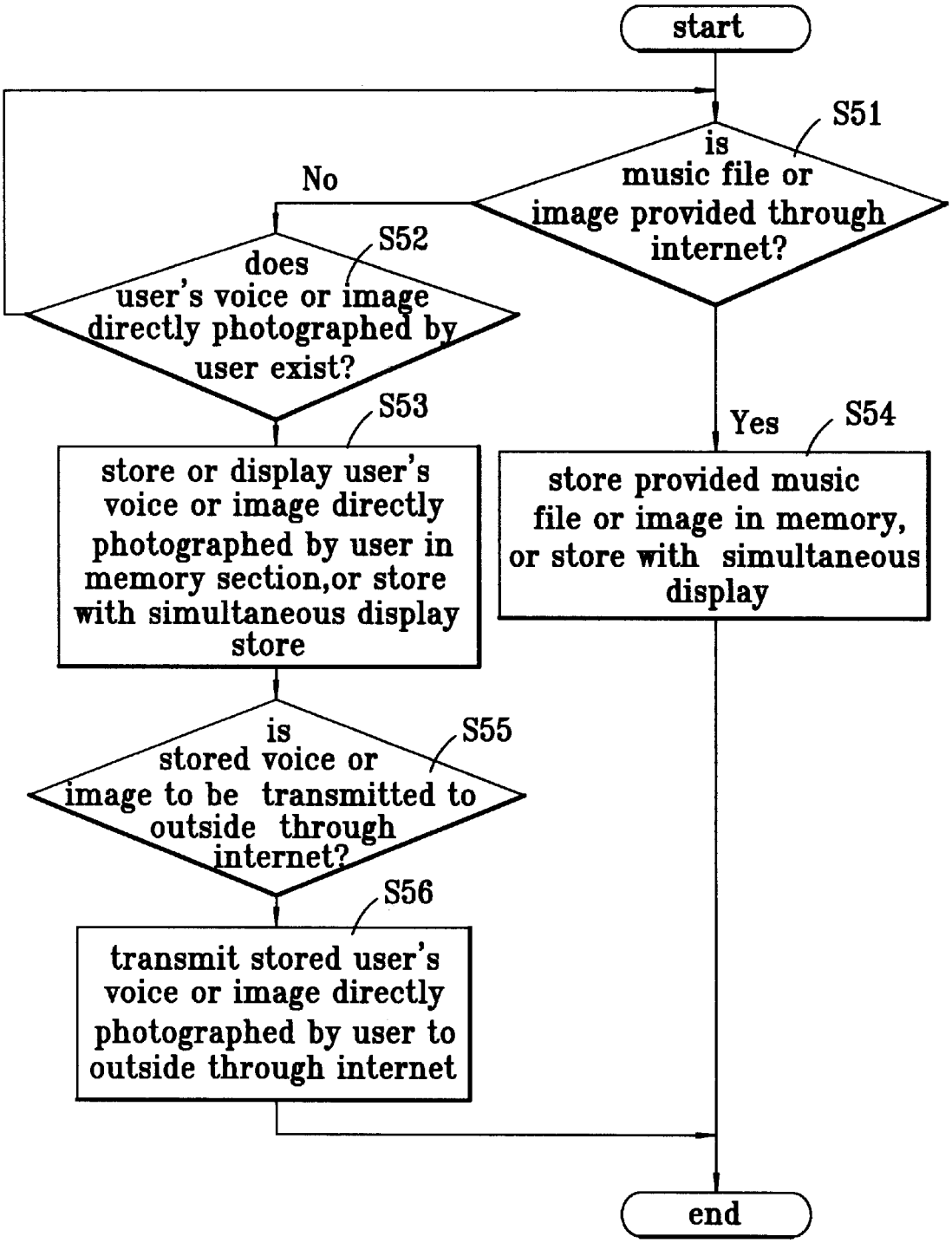
FIG. 15 is a flowchart illustrating a method of operating the Internet refrigerator for performing a multimedia function according to a third embodiment of the present invention.

FIG. 15 is a flowchart illustrating the Internet refrigerator operating process for performing the multimedia function. As shown in FIG. 15, if the user manipulates the keyboard 190 to store his/her voice and to photograph by the camera 90 the moving image including himself/herself and his/her surroundings (for example, a housewife, children, and kitchen) (step S51), the main microcomputer 30 controls the microphone 180 and the camera 90 to store the user s voice and the moving image in the memory 80 (step S52). At this time, the main microcomputer 30 stores the voice and the moving image in the memory 80 as it displays the image through the LCD 120 and outputs the voice through the speaker 110 (step S52).

At this time, if the user intends to transmit in real time the voice and the moving image stored in the memory 80 to the external communication devices 130 to 190 through the Internet by providing the key signal through the keyboard 190 and so on (step S53), the main microcomputer 30 connects to the Internet by controlling the Internet connection device 40, and transmits the image and voice signals stored in the memory 80 to the external communication devices 130 to 190 (for example, to his/her relative or friend) through the Internet (step S54).

Accordingly, the external communication devices 130 to 190, which correspond to the user s relative and friend, can listen to the voice and view the moving image in real time.

Also, the user can listen to and view the signals stored in the memory 80 through the speaker 110 and the LCD 120, respectively, by reproducing the signals under the control of the main microcomputer 30. Also, the user can make the main microcomputer 30 connect to the Internet through the Internet connection device 40 by manipulating the keyboard 190.

After the connection, if the user is provided with a desired MP3 music file or a program of a moving image from the information provider 160 through the Internet (step S55), the main microcomputer 30 stores the music file or the moving image in the memory 80, and thus the user can listen to the music file through the speaker 110 and view the moving image program through the LCD 120 (step S56).

The moving image program includes a drama, movie, music video, documentary, etc., provided from the information provider 160 such as a broadcasting program.

Meanwhile, the user can also receive an MP3 music file transmitted from persons close to the user such as his/her relatives through the Internet or a moving image directly photographed by them through the Internet connection device 40. The main microcomputer 30 may directly store the music file and the moving image in the memory 80, or listen to the music file through the speaker 110 and view the moving image through the LCD 120 in real time while storing them in the memory 80. The music file or the moving image stored in the memory 80 may be read out by the main microcomputer 30 to be outputted or displayed.

As described above, according to the multimedia function as shown in FIG. 15, since the refrigerator can be connected to the Internet, the user in the kitchen can store the voice and the moving image, and listen to and view the voice and the moving image by reproducing the stored voice and moving image.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. An Internet refrigerator comprising:

a refrigerator control section for controlling constituent elements of the refrigerator;

a touch panel for providing key signals related to an operation of the refrigerator itself and key signals for effecting communications with the Internet according to a user s selection;

a remote controller for remotely providing the key signals related to the operation of the refrigerator itself and the key signals for effecting communications with the Internet according to the user's selection;

a display section, provided on an outer wall of the refrigerator, for displaying information related to the operation of the refrigerator itself and information obtained from the Internet in response to the key signals from the touch panel and the key signals from external devices through the Internet;

a main control section for performing a bidirectional communication with the refrigerator control section and the Internet and controlling the display section in response to the key signals from the touch panel, the key signals from the Internet and the key signals from the remote controller;

a dedicated communication control section for managing the bidirectional communication between the refrigerator control section and the main control section; and a modem connected between the Internet and the main control section by a dedicated communication line for the bidirectional communication between the Internet and the main control section.

2. The Internet refrigerator as claimed in claim 1, further comprising:

a microphone connected to the main control section for an voice communication with the Internet;

a speaker for outputting voice information according to the operation of the refrigerator itself and the use of the Internet through the refrigerator under the control of the main control section;

an electric pen for applying required information on the touch panel by being manipulated by the user; and a memory for storing necessary text, voice, and image information, and outputting the stored information under the control of the main control section.

3. The Internet refrigerator as claimed in claim 1, wherein the voice, text, and image information stored in the memory are information prepared by the user, or a music file or a moving image provided from a service provider through the Internet.

4. The Internet refrigerator as claimed in claim 1, further comprising a keyboard, connected by wire to the main control section, for providing to the main control section the key signals for operating the refrigerator itself and the key for effecting communications with the Internet in accordance with the user's selection.

5. The Internet refrigerator as claimed in claim 1, wherein the dedicated communication line is an RS232.

6. The Internet refrigerator as claimed in claim 1, wherein the information sent/received between the main control section and the external devices through the Internet includes a signal for informing the operation state of the refrigerator, a signal corresponding to a user manual of the refrigerator, a signal corresponding to information on foodstuffs stored in the refrigerator, a signal corresponding to cooking information, a signal corresponding to menu information for health, a signal corresponding to a message, a signal corresponding to memo information, a signal corresponding to schedule management, a signal corresponding to voice and image information, a television broadcasting signal, an MPEG signal, a signal, a signal related to an after-sale service of the refrigerator, a signal for externally controlling the operation of the refirgerator, a signal corresponding to living information, a signal corresponding to stock information, and a signal for Internet operation.

7. The Internet refrigerator as claimed in claim 6, wherein the external devices are a personal computer, a celluar phone, a wire telephone set, and a PCS.

8. The Internet refrigerator as claimed in claim 1, wherein the display section is an LCD panel, and the touch panel is unitedly provided on a screen of the LCD panel.

9. The Internet refrigerator as claimed in claim 1, wherein the touch panel comprises:

a message key used for a memo transferring function among members of a family;

an MPEC3 key for listening to a music file and accessing a moving image;

an Internet key for accessing the Internet;

a food key for grasping information on foodstuffs in the refrigerator;

an information key for accessing general information including living information;

a photo key for accessing image and photograph information;

a schedule key used for scheduling information such as a special anniversary, an important appointment day, and a phone number list; and an operating key for operating the refrigerator.

10. The Internet key as claimed in claim 9, wherein the respective key comprises a correction key, a delete key, and a write key in a corresponding sub-window.

11. The Internet refrigerator as claimed in claim 9, wherein the message key is provided in a sub-window on a screen of the display section, and includes an input key for selecting an input of a message, and an output key for selecting an output of the message.

12. The Internet refrigerator as claimed in claim 11, wherein the input key is provided in a sub-window corresponding to the input of the message, and includes a visual message key, a text message key for inputting a text message, a new message key for inputting a new message, and a save key for saving a certain written image.

13. The Internet refrigerator as claimed in claim 9, wherein the schedule key is provided in a sub-window on a screen of the display section, and includes a day key for inputting/outputting required information in the unit of a day, a month key for inputting/outputting required information in the unit of a month, and a year key for inputting/outputting required information in the unit of a year.

14. The Internet refrigerator as claimed in claim 13, the schedule key includes an anniversary key for marking an anniversary on a calendar, a birthday key for marking a birthday, and a special day key for marking a special day.

15. The Internet refrigerator as claimed in claim 1, wherein the information displayed on the display section under the control of the main control section includes text information and image information.

16. A method of operating an Internet refrigerator having a key input device, a display device, and an Internet connection device, the method comprising the steps of:

(a) detecting a key signal inputted from the key input device by a user and inputted from external devices through the Internet connection device;

(b) controlling constituent elements of the refrigerator in response to the key signal if it is detected that the key signal is related to an operation of the refrigerator itself;

(c) displaying through the display device first information from the refrigerator itself and from the external devices in response to the key signal if it is detected that the key signal is a signal for displaying the first information;

(d) transmitting second information of the refrigerator to the external devices in response to the key signal if it is detected that the key signal is a signal for transmitting the second information to the external devices through the Internet connection device; and (e) storing third information from the refrigerator itself and from the external devices through the Internet connection device in a memory of the refrigerator in response to the key signal if it is detected that the key signal is a signal for storing the third information in the memory.

17. The method as claimed in claim 16, wherein the key input device is one among a keyboard attached to the refrigerator, a touch panel unitedly formed on a screen of the display device, and a remote controller.

18. The method as claimed in claim 16, wherein at step (a), the key signals related to the operation of the refrigerator itself includes a signal for turning on/off the power supply of the refrigerator, a signal for adjusting a temperature in the refrigerator, and a signal for determining or converting a state of the refrigerator into a refrigerating state or a freezing state.

19. The method as claimed in claim 16, wherein the step 8 comprises the steps of:

if the key signal for display is a key signal related to a manual, displaying a structure of the refrigerator on a screen of the display device;

enlarging and displaying a constituent element selected from the structure of the refrigerator by the user; and displaying information on the operation, function, and parts of the constituent element of the refrigerator selected by the user.

20. The method as claimed in claim 16, further comprising the steps of:

if the key signal is a signal related to input/output of a message and memo at steps (d) and (e), verifying qualification of the user who requested input/output of the second information and the third information corresponding to the message and the memo; and if the qualification of the user is approved, inputting the second information and the third information corresponding to the message and the memo from the external devices, or outputting them to the refrigerator or from the refrigerator to the external devices through the Internet connection device.

21. The method as claimed in claim 20, wherein the second information and the third information corresponding to the message and the memo includes text information, voice information, and image information.

22. The method as claimed in claim 16, wherein at step (e), the third information to be stored in the memory is one among a voice of the user, a moving image personally prepared by the user, and a voice, a music file, or a moving image provided from program providers through the Internet.

23. The method as claimed in claim 16, wherein at step (d), the the second information to be transmitted from the memory to the external devices through the Internet according to the user s selection is one among a voice of the user, a moving image personally photographed by the user, and a voice, a music file, or a moving image provided from program providers through the Internet.

24. The method as claimed in claim 16, wherein at step (e), the third information is displayed on the display device in real time, and simultaneously stored in the memory according to the user s selection.

25. The method as claimed in claim 16, wherein at step (e), the third information to be stored in the memory is at least one among information on foodstuffs stored in the refrigerator stored in the memory by the user, cooking information and menu information personally prepared by the user in consideration of dieting and health, and cooking information and menu information in consideration of dieting and health provided from program providers through the Internet.

26. The method as claimed in claim 16, wherein at steps (c), (d), and (e), the first to third information are information on personal and family schedules corresponding to an appointment day and an event day.

27. The method as claimed in claim 16, wherein at step (e), the third information is provided by a provider of the refrigerator, and is an updated version of a user manual of the refrigerator previously stored in the memory.

28. The method as claimed in claim 16, wherein at steps (c), (d), and (e), the first to third information are information related to an Internet after-sale service between the refrigerator and a service center.

29. The method as claimed in claim 28, the first information is information for diagnosing trouble of sensors installed in the refrigerator, trouble of a compressor, and trouble of other components of the refrigerator, the second information is information on a present state of the sensors, compressor, and other components to be sent to the service center, and the third information is information on the diagnosis result from the service center in accordance with the present state of the components.

30. The method as claimed in claim 16, wherein the displayed first information is information on a present temperature of a freezing room of the refrigerator, a present temperature of a refrigerating room, a door open/close state of the refrigerator, a compressor on/off state pf the refrigerator, and a filter exchange time of the refrigerator.

* * * * *